US007290663B2

(12) United States Patent
Deng et al.

(10) Patent No.: US 7,290,663 B2
(45) Date of Patent: Nov. 6, 2007

(54) FOLDING CONTAINER

(75) Inventors: Chien-Sung Deng, Miao-Li (TW); Hung-Wen Yang, Miao-Li (TW)

(73) Assignee: Innolux Display Corp., Miao-Li (TW)

( * ) Notice: Subject to any disclaimer, the term of this patent is extended or adjusted under 35 U.S.C. 154(b) by 474 days.

(21) Appl. No.: 10/871,145

(22) Filed: Jun. 18, 2004

(65) Prior Publication Data

US 2005/0279666 A1 Dec. 22, 2005

(30) Foreign Application Priority Data

Jun. 18, 2003 (TW) ..... 92116594 A

(51) Int. Cl.
*B65D 85/48* (2006.01)

(52) U.S. Cl. ..... 206/600; 206/454; 220/6

(58) Field of Classification Search ..... 220/4.28, 220/4.32, 4.33, 4.34, 6; 206/600, 454, 456
See application file for complete search history.

(56) References Cited

U.S. PATENT DOCUMENTS 4,684,034 A 8/1987 Ono et al.
4,863,056 A 9/1989 Inayama
5,038,953 A * 8/1991 Radar ..... 220/6
5,253,763 A * 10/1993 Kirkley et al. ..... 206/600
5,950,836 A * 9/1999 Iwamoto et al. ..... 206/711
6,616,003 B1 * 9/2003 Polenta ..... 220/7
6,868,979 B2 * 3/2005 Rader ..... 220/7
2004/0222221 A1 * 11/2004 Rader ..... 220/6
2004/0256385 A1 * 12/2004 Hartwall ..... 220/6

* cited by examiner

*Primary Examiner*—David T. Fidei
(74) *Attorney, Agent, or Firm*—Wei Te Chung

(57) ABSTRACT

A folding container (3) comprises: an upper frame (31) including a pair of first and second opposite sides; a pair of side plates (35) being pivotally connected to a respective first side and movable relative to the upper frame; a pair of folding plates (37) positioned between the side plates, each of the folding plates including an upper plate (371) and a lower plate (373), each of the upper plate being pivotally connected to a respective second side; a bottom plate (33) including a pair of second opposite sides corresponding to the second sides of the upper frame, each lower plate being pivotally connected to the bottom plate, the side plates and folding plates and bottom plate cooperatively forming a receptacle; and a pair of slot plates (38) with a plurality of slots (381), each of the slot plates being adjacent to a respective one of the side plates.

13 Claims, 5 Drawing Sheets

FOLDING CONTAINER

BACKGROUND OF THE INVENTION

1. Field of the Invention

The present invention relates to a container, and especially to a folding container used for transporting or shipping Liquid Crystal Display (LCD) panels.

2. Description of Prior Art

The process of fabricating an LCD generally comprises forming an LCD panel (known as a "cell process"), and assembling the LCD panel with other parts such as a driving integrated circuit (IC), a printed circuit board (PCB), a backlight system, etc. (known as a "modular process"). The cell process and the modular process are usually performed at different factories in different districts of a country or even in different countries. This is because the modular process is generally labor-intensive. Therefore, after the cell process, the LCD panels are generally shipped or transported to another district or country where labor costs are most favorable.

A conventional container used to transport LCD panels is shown in FIG. 6. The container comprises a main body 11 having a parallelepiped configuration, and a cover (not shown). The main body 11 comprises a pair of opposite side plates 13, 15. Each side plate 13, 15 defines a plurality of vertical slots 131, 151. Each pair of corresponding opposite slots 131, 151 receives and holds an LCD panel 2. After all the LCD panels 2 are received in the main body 11, the cover is attached on the main body 11, thereby forming a protective receptacle for the LCD panels 2.

The container is made of expanded polypropylene (EPP), so that it has good shock-proof characteristics. In addition, a plurality of the containers is secured in a larger, strong receptacle (not shown), to protect the containers from being accidentally hit or squeezed during transportation. The larger receptacle is also parallelepiped-shaped, so that it can easily receive the containers and provide sufficient protection therefor.

However, once the LCD panels 2 are unloaded from the containers, the empty containers must be returned to the cell process factory from which they came. The empty containers take up a lot of space, which results in high freight costs.

An improved container that overcomes the above-mentioned disadvantages is desired.

SUMMARY OF THE INVENTION

An object of the present invention is to provide a folding container which can be folded to a compact size when not in use.

In order to achieve the object set forth above, a folding container in accordance with the present invention comprises: a rectangular upper frame including a pair of first opposite sides each having an inside part that is provided with a plurality of first engaging portions, and a pair of second opposite sides each having an inside part that is provided with a plurality of second engaging portions; a pair of side plates each including a plurality of third engaging portions, each of the side plates being pivotally connected to the first engaging portions of a respective first side of the upper frame via the third engaging portions, whereby the side plates are movable relative to the upper frame; a pair of folding plates positioned between the side plates, each of the folding plates including an upper plate and a lower plate pivotally connected to the upper plate, the upper plate being pivotally connected to the second engaging portions of a respective second side of the upper frame; a bottom plate including a pair of second opposite sides corresponding to the second sides of the upper frame, each of the second sides of the bottom plate having a plurality of fourth engaging portions, each of the lower plates being pivotally connected to respective fourth engaging portions of the bottom plate, the side plates, folding plates and bottom plate cooperatively forming a receptacle; and a pair of slot plates with a plurality of slots, each of the slot plates being adjacent to a respective one of the side plates.

The folding container of the present invention can be easily folded and loaded into a vehicle so that it occupies a substantially reduced space. This can commensurately reduce freight costs when returning the empty folding container to its source.

Other objects, advantages, and novel features of the present invention will become more apparent from the following detailed description of preferred embodiments when taken in conjunction with the accompanying drawings, in which:

DETAILED DESCRIPTION OF THE PRESENT INVENTION

Reference will now be made to the drawings to describe the present invention in detail.

Figure 1:
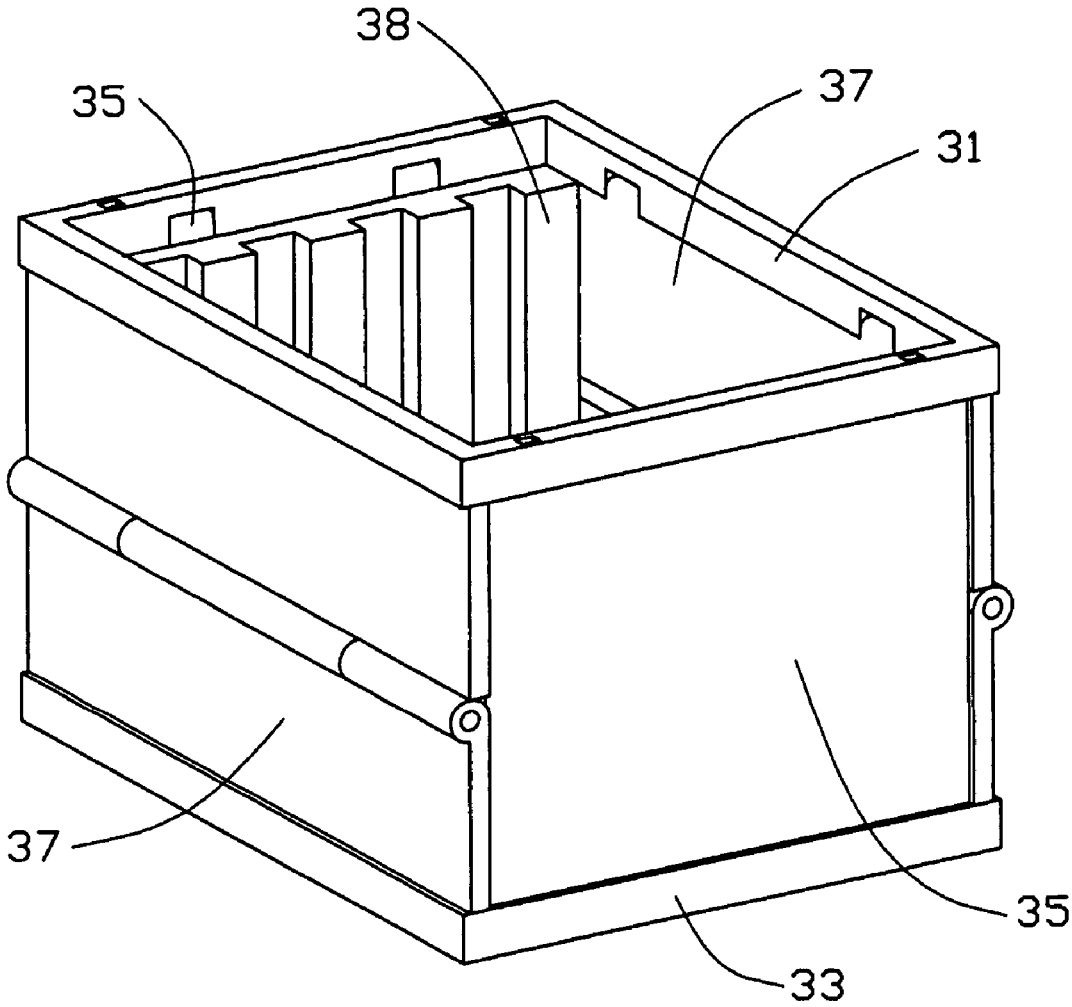
FIG. 1 is an isometric view of a first embodiment of a folding container according to the present invention, but not showing a cover thereof.
Figure 2:
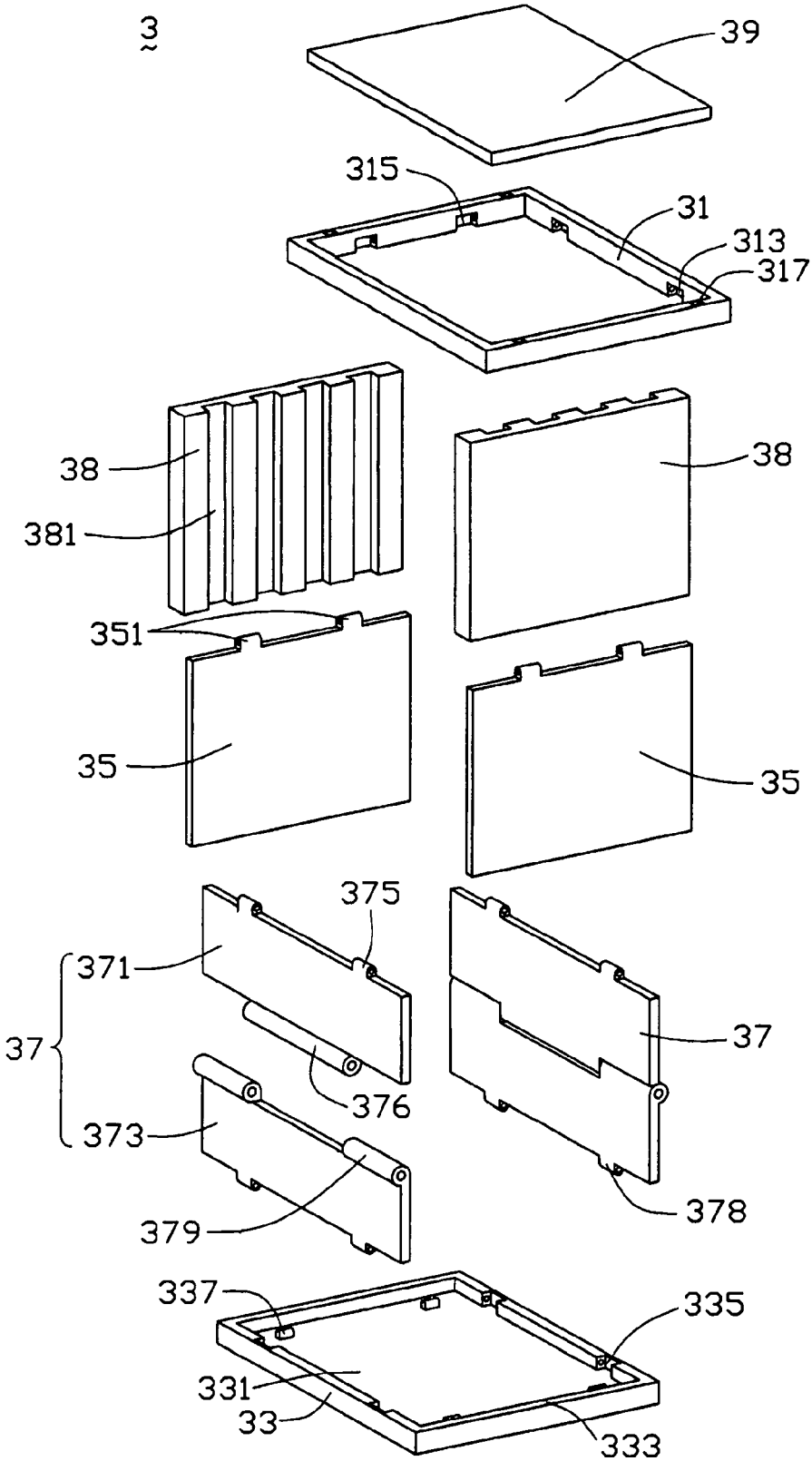
FIG. 2 is an exploded, isometric view of the first embodiment of the folding container according to the present invention.

Referring to FIG. 1 and FIG. 2, a folding container 3 in accordance with a first embodiment of the present invention comprises an upper frame 31, a bottom plate 33, a pair of opposite side plates 35, a pair of folding plates 37 positioned between the pair of side plates 35, and a pair of slot plates 38. The side plates 35, folding plates 37, and bottom plate 33 cooperatively form a receptacle having an opening. Each slot plate 38 is adjacent to a respective side plate 35. The folding container 3 further comprises a cover 39 to cover the opening of the receptacle.

The slot plates 38 are made of EPP. The upper frame 31, side plates 35, folding plates 37 and bottom plate 33 are made of electrostatic discharge protected plastic. Moreover, one of the folding plates 37 can be made of transparent plastic, so that a user can observe the inside of the folding container 3.

The upper frame 31 is rectangular with a hollow middle. Two folding plate engaging portions 313 are formed in inside parts of each of two opposite long sidewalls (not labeled) of the upper frame 31. The folding plate engaging portions 313 are configured as hinge-like sockets. Two side plate engaging portions 315 are formed in inside parts of each of two opposite short sidewalls (not labeled) of the upper frame 31. The side plate engaging portions 315 are configured as hinge-like sockets. Two holes 317 are defined in an upper surface (not labeled) of each of the short sidewalls of the upper frame 31.

The bottom plate 33 comprises a base 331, and a rectangular frame 333 extending from four sides of the base 331. Two folding plate engaging portions 335 are defined at each of two opposite long sidewalls (not labeled) of the rectangular frame 333. The folding plate engaging portions 335 are configured as hinge-like sockets. The base 331 comprises two engaging protrusions 337 adjacent to the each of two opposite short sidewalls of the rectangular frame 333. Opposite surfaces of the engaging protrusions 337 are sloped.

Each side plate 35 is rectangular, and comprises a top edge and a bottom edge. The top edge has two engaging portions 351. The engaging portions 351 are configured to be hinge-like. The bottom edge defines two engaging grooves (not shown), matching with corresponding engaging protrusions 337 of the base 331.

Each folding plate 37 comprises an upper plate 371 and a lower plate 373. The upper plate 371 comprises a bottom engaging portion 376, and the lower plate 373 comprises two spaced top engaging portions 379. The bottom engaging portion 376 and the top engaging portions 379 are each configured to be hinge-like. The upper plate 371 is pivotally connected to the lower plate 373 by way of a pin (not shown) being received through the bottom and top engaging portions 376, 379. A top edge of the upper plate 371 comprises two engaging portions 375, corresponding to respective engaging portions 313 of the upper frame 31. The engaging portions 375 are configured to be hinge-like. A bottom edge of the lower plate 373 comprises two engaging portions 378, corresponding to respective folding plate engaging portions 335 of the rectangular frame 333. The engaging portions 378 are configured to be hinge-like.

The slot plates 38 are rectangular, and each defines a plurality of parallel slots 381. A length and a width of each slot plate 38 is respectively equal to those of either side plate 35. However, a thickness of each slot plate 38 can vary according to need.

A bottom face of the cover 39 has four pins (not shown), corresponding to the holes 317 of the upper frame 31.

In assembly, the side plates 35 and the folding plates 37 are positioned between the upper frame 31 and the bottom plate 33. Each slot plate 38 is adjacent to an inside of a respective side plate 35. Each side plate 35 is pivotally connected to the corresponding side plate engaging portions 315 of the upper frame 31 via the engaging portions 351, so as to be movable relative to the upper frame 31. The engaging grooves of the bottom edges of the side plates 35 can engagingly receive the engaging protrusions 337 of the base 331 when the side plates 35 are erect. Each upper plate 371 is pivotally connected to the corresponding folding plate engaging portions 313 of the upper frame 31, and each lower plate 373 is pivotally connected to the corresponding folding plate engaging portions 335 of the bottom plate 33. If desired, each slot plate 38 can be fixed to its corresponding side plate 38 by fastening means such as screws, adhesive, or the like. Alternatively, each slot plate 38 may instead be adjacent to a respective folding plate 37. In such case, a size of the slot plate 38 is configured to correspond to a size of the folding plate 37. If desired, each slot plate 38 can be fixed to its corresponding folding plate 37 by fastening means such as screws, adhesive, or the like.

After assembly of the folding container 3, an LCD panel (not shown) can be inserted into each pair of corresponding slots 381. The cover 39 is then mate with the upper frame 31. Thus, the receptacle with the LCD panels therein is sealed. Moreover, the pins of the cover 39 are engagingly received in the holes 317 of the upper frame 31 so that the cover 39 is firmly mated with the upper frame 31.

Figure 3:
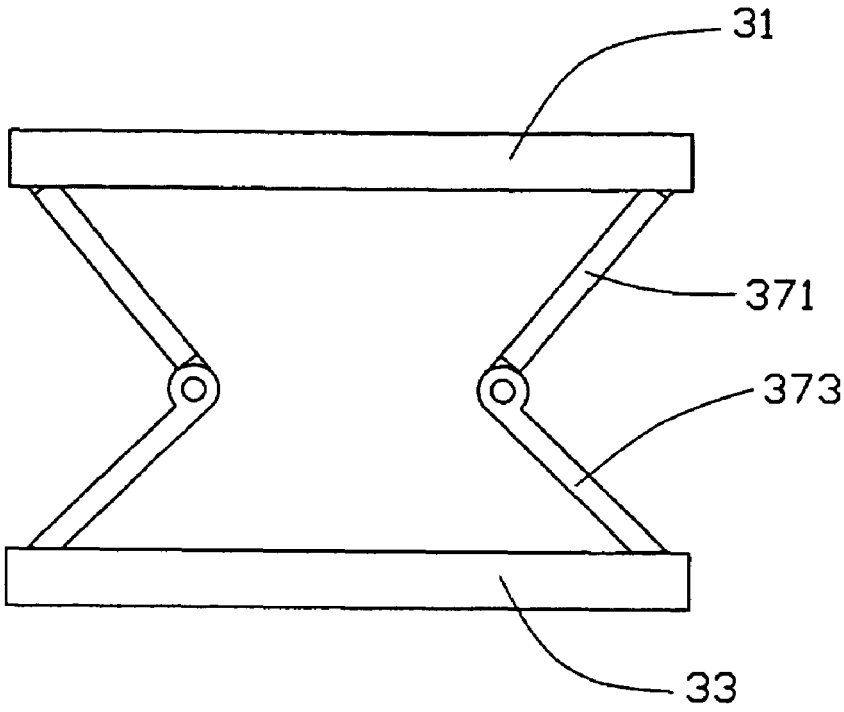
FIG. 3 is an end elevation of the folding container of FIG. 1, but showing the folding container in the process of being folded.
Figure 4:
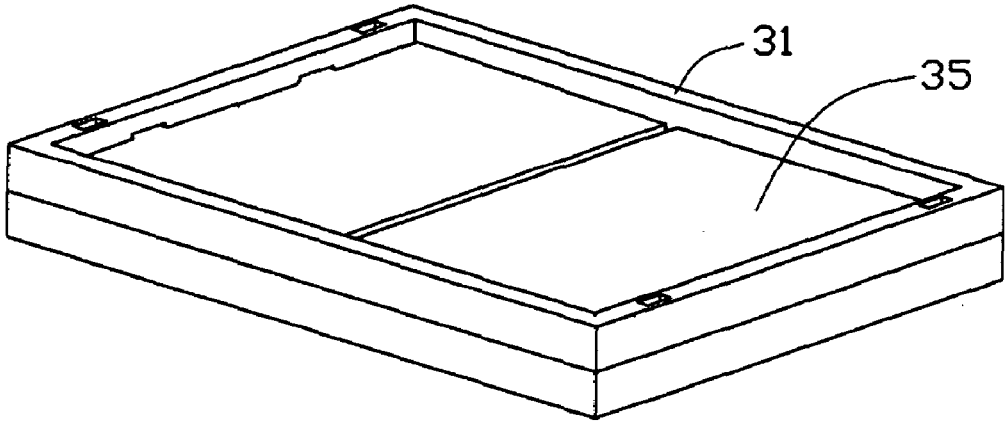
FIG. 4 is an isometric view of the folding container of FIG. 1 in a folded state.

Referring to FIGS. 3 and 4, to fold the empty container 3, the LCD panels are firstly unloaded therefrom. Then the following steps are performed: firstly, the slot plates 38 are taken out from the receptacle; secondly, the side plates 35 are rotated from the erect positions up to horizontal positions; and thirdly, the folding plates 37 are pushed respectively inwardly, so that corresponding upper and lower plates 371, 373 overlap each other.

FIG. 4 shows the folding container 3 in a folded state. The pair of side plates 35, the pair of folding plates 37 and the bottom plate 33 are overlapped one on the other in sequence, such that overall the folding container 3 is thin. Thus, the space occupied by the folding container 3 is dramatically reduced. This can significantly reduce freight costs when empty folding containers 3 are returned to their source after use. Also, because the slot plates 38 are substantially flat, they can be conveniently stacked one on the other separate from the folding container 3. Alternatively, the slot plates 38 can be placed on the cover 39 within the baseframe 333 of the folding container 3.

Figure 5:
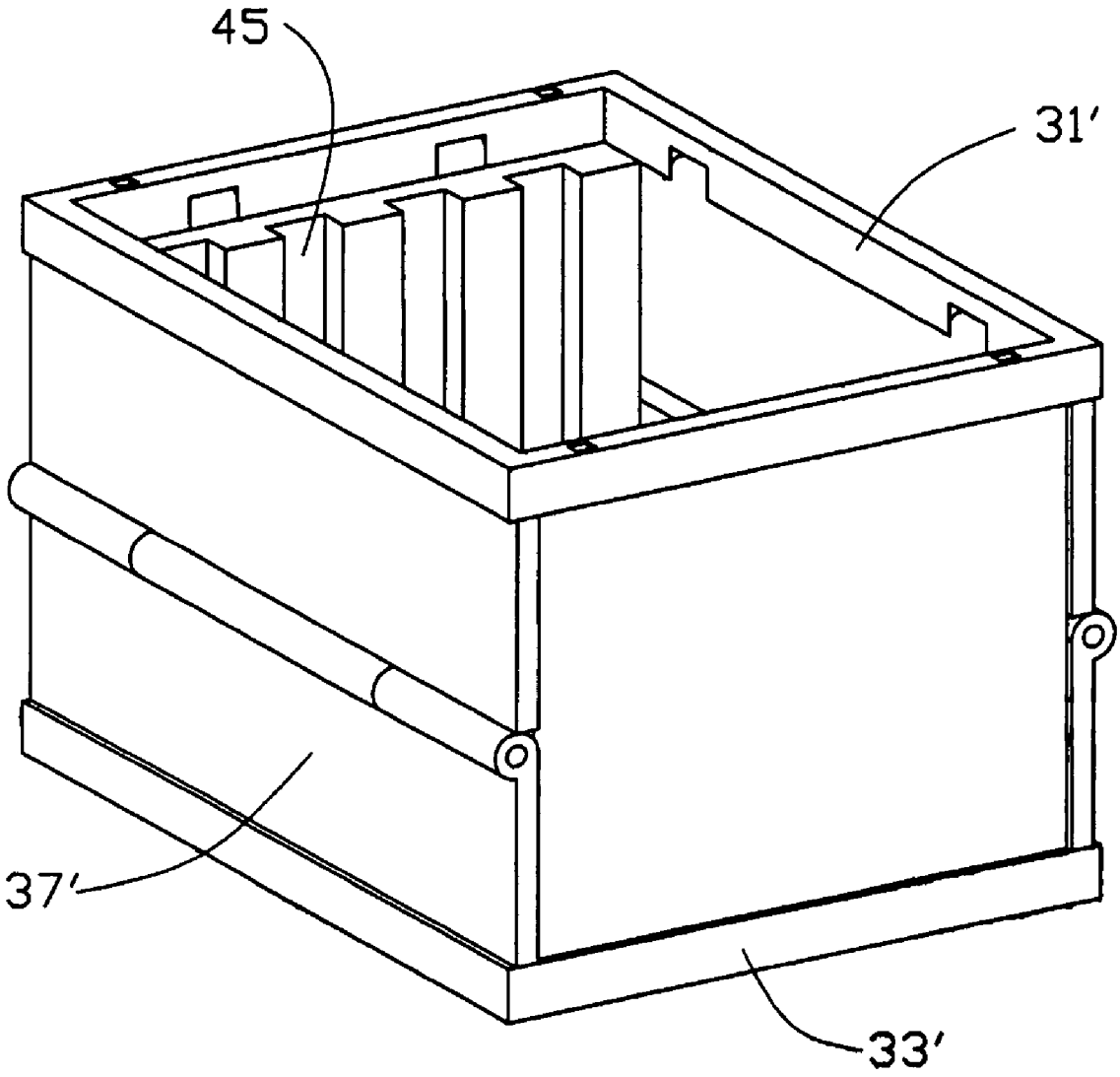
FIG. 5 is an isometric view of a second embodiment of a folding container according to the present invention, but not showing a cover thereof.
Figure 6:
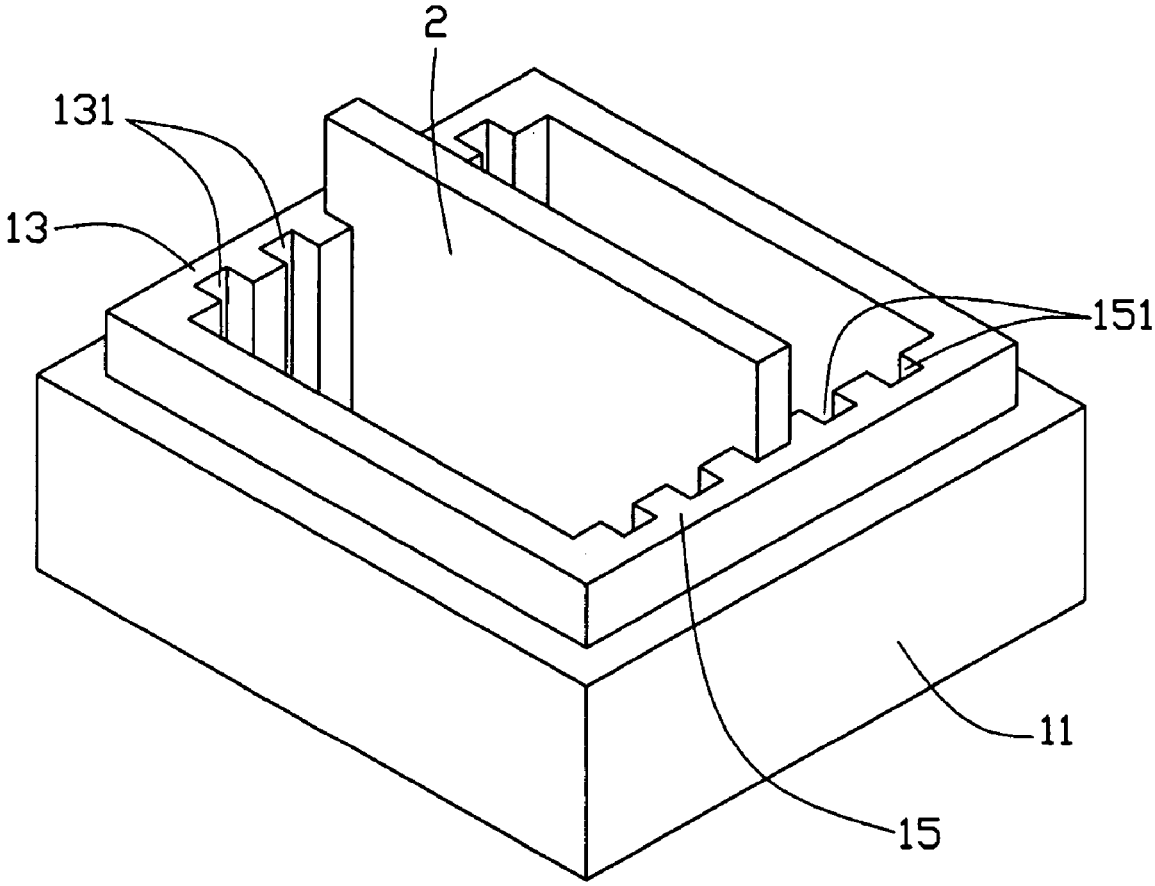
FIG. 6 (PRIOR ART)
FIG. 6 is an isometric view of a conventional container holding an LCD panel therein, but not showing a cover of the container.

FIG. 5 shows a folding container in accordance with a second embodiment of the present invention, except for a cover thereof. The folding container is similar to the folding container 3 of the first embodiment, and comprises an upper frame 31', a pair of folding plates 37', and a bottom plate 33'. The folding container also comprises a pair of side plates 45 each defining a plurality of slots (not labeled). The side plates 45 are made of EPP.

Assembly of the folding container of the second embodiment is similar to that of the folding container 3. The folding container has similar benefits to those of the folding container 3. Moreover, because each side plate 45 is an integrated body incorporating the slots, when the folding container of the second embodiment is folded, there are no separate slot plates. That is, there is no possibility of slot plates being misplaced.

In the embodiments described above, the connection of the side plates 35 with the upper frame 31, the upper plates 371 with the lower plates 373, and the folding plates 37 with the upper frame 31 and the bottom plate 33 is obtained by way of the above-described engaging portions. In the above-described embodiments, the engaging portions are all hinge-like. However, in further alternative embodiments, other kinds of engaging portions such as pivot members can be employed instead.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A folding container, comprising:

a rectangular upper frame including a pair of first opposite sides each having an inside part that is provided with a plurality of first engaging portions, and a pair of second opposite sides each having an inside part that is provided with a plurality of second engaging portions;

a pair of side plates each including a plurality of third engaging portions, each of the side plates being pivotally connected to the first engaging portions of a respective first side of the upper frame via the third engaging portions, whereby the side plates are movable relative to the upper frame;

a pair of folding plates positioned between the side plates, each of the folding plates including an upper plate and a lower plate pivotally connected to the upper plate, the upper plate being pivotally connected to the second engaging portions of a respective second side of the upper frame;

a bottom plate including a pair of second opposite sides corresponding to the second sides of the upper frame, each of the second sides of the bottom plate having a plurality of fourth engaging portions, each of the lower plates being pivotally connected to respective fourth engaging portions of the bottom plate, the side plates, folding plates and bottom plate cooperatively forming a receptacle; and a pair of slot plates with a plurality of slats, each of the slot plates being adjacent to a respective one of the side plates.

2. The folding container as recited in claim 1, further comprising a cover used to mate with the upper frame.

3. The folding container as recited in claim 1, wherein each of the slot plates is integrated with said respective one of the side plates.

4. The folding container as recited in claim 1, wherein each of the slot plates is fixed to said respective one of the side plates by fasteners or adhesive.

5. The folding container as recited in claim 1, wherein the slot plates are made of expanded polypropylene.

6. The folding container as recited in claim 1, wherein any one or more of the upper frame, side plates, folding plates and bottom plate is made of electro-static discharge protected plastic.

7. The folding container as recited in claim 1, wherein each of the slot plates is adjacent to a respective one of the folding plates.

8. The folding container as recited in claim 1, wherein the bottom plate further comprises a base and a rectangular frame extending from sides of the base, and the fourth engaging portions of the bottom plate are located at a pair of opposite second sides of the rectangular frame.

9. The folding container as recited in claim 8, wherein the base further comprises a plurality of engaging protrusions adjacent to a pair of opposite first sides of the rectangular frame, and each of the side plates further comprises a plurality of engaging grooves engagingly receiving the engaging protrusions.

10. The folding container as recited in claim 1, wherein the bottom plate further comprises a plurality of engaging protrusions adjacent to a pair of opposite first sides, and each of the side plates further comprises a plurality of engaging grooves engagingly receiving the engaging protrusions.

11. The folding container as recited in claim 1, wherein the first, second, third and fourth engaging portions are hinge-like.

12. The folding container as recited in claim 1, wherein at least one of the folding plates is made of transparent plastic.

13. A folding container, comprising:

a pair of first and second rectangular frame;

a pair of opposite first side walls located between said first frame and second frame, and each pivotally linked to only one of the first and second frames;

a pair of opposite second side walls located between said first and second frames and alternately arranged with said pair of first side walls in alignment with said first and second frames in a vertical direction;

each of said second side walls including upper and lower parts pivotally to each other, and the upper pan and the lower part respectively pivotally linked to the first and second frames, respectively; and a plurality of vertical slots unitarily formed in an interior face of each of the first side walls for respectively holding LCD (Liquid Crystal Display) panels, and interengagement means formed on a bottom edge portion of each of the first side walls for retaining the corresponding first side walls in a vertical position.

* * * * *